United States Patent [19]

Wheeler

[11] 4,397,051

[45] Aug. 9, 1983

[54] APPARATUS FOR LIFTING A HUMAN BEING

[75] Inventor: Herbert O. Wheeler, Lawrenceville, Ill.

[73] Assignee: Helen S. Ballas, Newton Falls, Ohio; a part interest

[21] Appl. No.: 259,043

[22] Filed: Apr. 30, 1981

[51] Int. Cl.[3] ..... A61G 7/10

[52] U.S. Cl. ..... 5/84; 5/81 B; 5/86

[58] Field of Search ..... 5/81 R, 81 B, 83, 84, 5/85, 86, 87, 88, 89, 61, 60

[56] References Cited

U.S. PATENT DOCUMENTS

| | | | |
|---|---|---|---|
| 1,977,944 | 10/1934 | Haskett | 5/84 |
| 3,506,985 | 4/1970 | Lang | 5/86 |
| 3,673,620 | 7/1972 | Saunders | 5/83 |
| 3,924,281 | 12/1975 | Gibbs | 5/81 R |

FOREIGN PATENT DOCUMENTS

| | | | |
|---|---|---|---|
| 806989 | 6/1951 | Fed. Rep. of Germany | 5/83 |

*Primary Examiner*—Alexander Grosz
*Attorney, Agent, or Firm*—Sabin C. Bronson

[57] ABSTRACT

An apparatus useful for lifting a human being from a surface comprising a stretcher adapted to be placed between the human being and the surface; a first motive system associated with a first side end of the stretcher and capable of lifting or lowering this first side end, as desired; and a second motive system removably associated with a second side end of the stretcher and being capable of lifting or lowering this second side end, as desired, provided that the first and second motive systems are capable of independent operation.

6 Claims, 4 Drawing Figures

APPARATUS FOR LIFTING A HUMAN BEING

BACKGROUND AND SUMMARY OF THE INVENTION

This invention relates to an apparatus useful for lifting a human being. More particularly, this invention relates to an apparatus useful to lift an incapacitated human being, e.g., hospital patient, from a surface, e.g., bed, operating table and the like.

Incapacitated human beings, e.g., hospital patients, cause many problems, e.g., for hospital attendants. For example, it is difficult to replace bed linen when the patient is not able to get out of bed. Another instance, involves moving an unconscious surgery patient from the operating room back to his or her own quarters. In these and other situations, it is important that the patient be handled as little as possible and be treated with great gentleness.

Therefore, one object of the present invention is to provide an improved apparatus useful for lifting a human being from a surface.

Another object of the present invention is to provide an improved apparatus useful for lowering a human being to a surface. Other objects and advantages of the present invention will become apparent hereinafter.

An improved apparatus useful for lifting (or lowering) a human being from (or to) a surface has now been discovered. The present apparatus comprises a stretcher means adapted to be placed between the human being, e.g., hospital patient, and the surface, e.g., hospital bed, operating table and the like. The stretcher means has substantially mutually opposing first and second side ends and is capable of supporting the human being. A first motive means is included and is associated with the first side end of the stretcher means. This first motive means is capable of lifting or lowering the first side end, as desired. Also included is a second motive means which is removably associated with the second side end of the stretcher means. This second motive means is capable of lifting or lowering the second side end, as desired. In addition, the first and second motive means are structured to be capable of independent operation.

The present apparatus provides substantial benefits. Incapacitated patients can be lifted from hospital beds easily, effectively and reliably with a minimum of human contact.

In one preferred embodiment, the present apparatus further comprises a frame means associated with the stretcher means and the first and second motive means. This frame means acts to support the stretcher means and the two motive means. In this embodiment the present apparatus is conveniently a reasonably compact, efficiently structured unit. In a further preferred embodiment, the frame means is portable, for example, by placing the frame means on wheels and the like. This further embodiment gives the present apparatus substantial flexibility. For example, the apparatus can be moved from bed to bed, as needed, to lift and lower a number of patients in turn a their individual bed linen is changed. Also, this portability feature allows the present apparatus to be used to trnasport a surgery patient from the operating room to his or her own quarters and then conveniently and carefully placed on his or her own hospital bed for further recovery.

In another perferred embodiment, the first and second motive means act automatically to lift or lower the first and second side ends, respectively, of the stretcher means, as desired. The term "automatically" as used herein means that the lifting or lowering of the side ends of the stretcher means is done by a force other than manual labor. Of course, both first and second motive means are capable of being controlled by human beings. However, this "automatic" feature of the present invention improves the ease with which the apparatus can be used.

In one more preferred embodiment, each of the first and second motive means involves an electric motor and a plurality of cables (still more preferably, each of the motive means involves three such cables) associated with both the electric motor and the stretcher means. The independent operation of each of the electric motors causes movement in the cables and, in turn the lifting or lowering of the appropriate side end of the stretcher means, as desired. The use of electric motors is a particularly advantageous means of achieving automatic lifting or lowering of the first and second side ends of the stretcher means.

In an additional preferred embodiment, the present apparatus further comprises first and second governor means associated with the first and second motive means, respectively. These first and second governor means act to limit the distance, in which the first and second side ends, respectively, of the stretcher means are moveable, e.g., liftable or lowerable. In one particularly preferred embodiment, where each of the motive means comprise an electric motor, each of the governor means includes a upper and a lower switch and a contact block on one of the cables comprising the appropriate motive means. The upper and lower switches act to deactivate the appropriate electric motor in response to the contact block activating either the appropriate upper or lower switch, thereby causing the movement of the appropriate side end of the stretcher means to stop.

As noted previously, the second side end of the stretcher means is removably associated with the second motive means. One preferred means of providing this removable association is to provide each of the cables of the second motive means with a ring or hook element and to provide a corresponding number of hook or ring elements at or near the second end of the stretcher means. The ring or hook elements on the cables are capable of being removably associated with the corresponding hook or ring elements at or near the second side end of the stretcher means.

In an additional preferred embodiment, the first and second motive means further include first and second pulley systems, respectively. These first and second pulley systems act to direct the movement of the cables of the first and second motive means, respectively, to, for example, promote the ease of lifting and lowering the stretcher means.

These and other aspects and advantages of the present invention are set forth in the following detailed description, particularly when considered in conjunction with the accompanying drawings in which like parts bear like reference numerals.

DESCRIPTION OF THE PREFERRED EMBODIMENT

Figure 1:
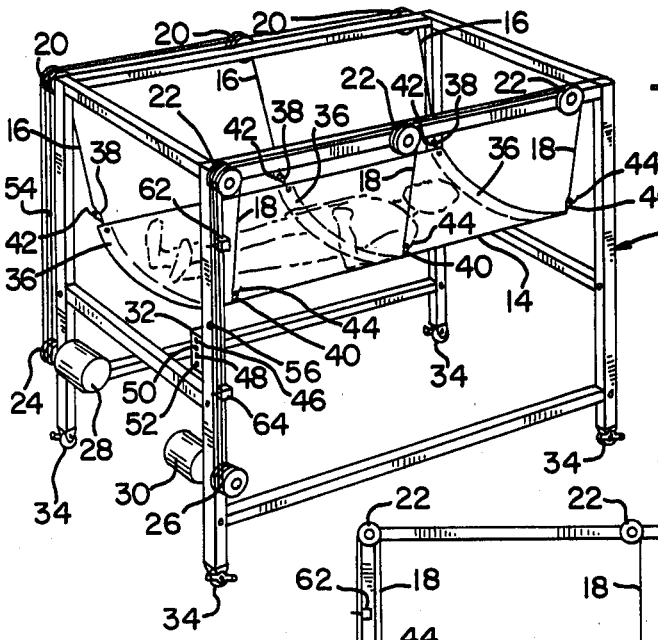
FIG. 1 is a front-side view, in perspective of one embodiment of the present apparatus.
Figure 2:
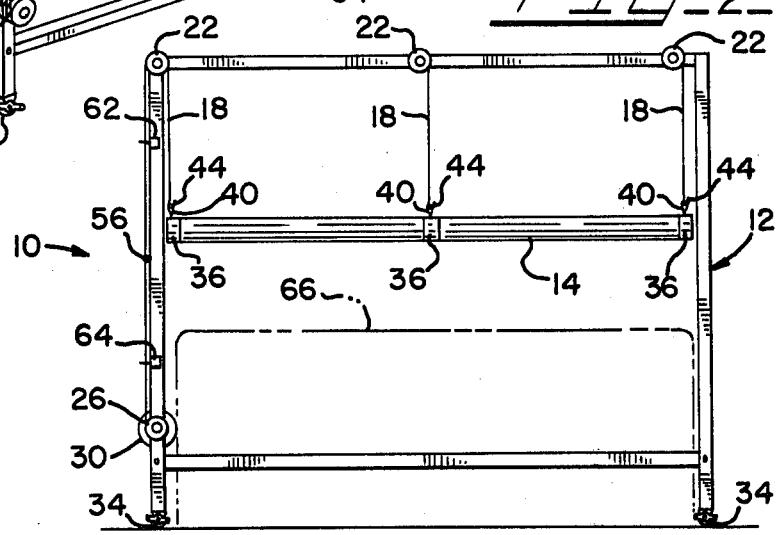
FIG. 2 is a side plan view of the embodiment shown in FIG. 1.
Figure 3:
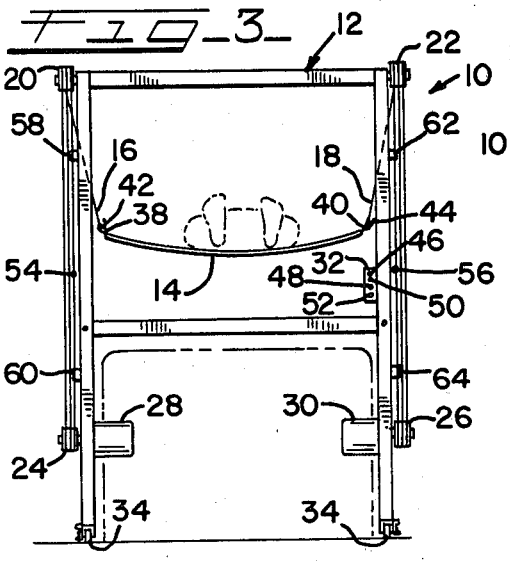
FIG. 3 is a front plan view of the embodiment shown in FIG. 1 showing the hospital patient in the lifted position.
Figure 4:
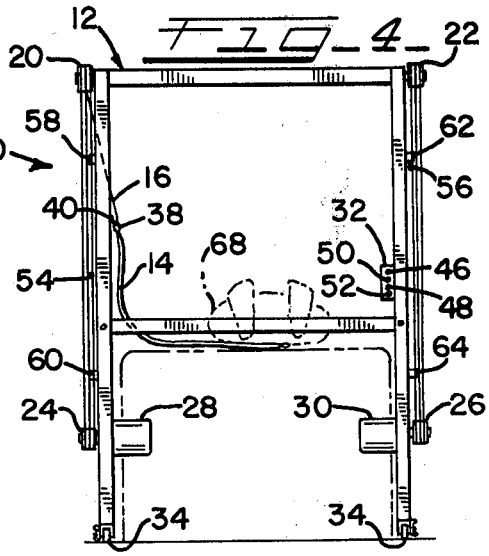
FIG. 4 is a front plan view of the embodiment shown in FIG. 1 showing the hospital patient placed back on the hospital bed.

Referring now to the drawings, the embodiment of the body lift, shown generally at 10, includes a frame 12, a stretcher 14 suspended by first cables 16 and second cables 18, first pulleys 20, second pulleys 22, first cable reel 24, second cable reel 26, first electric motor 28, second electric motor 30 and motor control box 32. The legs of frame 12 are on wheels 34, thereby allowing body lift 10 to be portable. It is of course understood that the wheels 34 are provided with brake-locks to hold the body lift stationary when desired. As can be seen by the drawings, first and second pulleys 20 and 22, first and second electric motors 28 and 30 and motor control box 32 are all secured to frame 12.

Stretcher 14 includes three nylon straps 36 which act to provide added strength to stretcher 14. Each of straps 36 terminate (or end) on either side of stretcher 14 and have a series of three first rings 38 and three second rings 40 attached near such ends. Each of first cables 16 terminate in a first hook 42, and each of second cables 18 terminate in a second hook 44. First hooks 42 and second hooks 44 can be disengaged from first rings 38 and second rings 40, respectively, as desired to disengage one or more side ends of stretcher 14 from first cables 16 and second cables 18, respectively.

Each of first cables 16 extend from first hook 42 around at least one first pulley 20 and then down to first cable reel 24 to which the other end of each first cable 16 is attached. Similarly, each of second cables 18 extend from second hooks 44 around at least one second pulley 22 and then down to second cable reel 26 to which the other end of each second cable 18 is attached. As can be seen from the drawings, one first cable 16 contacts one first pulley 20, one first cable 16 contacts two first pulleys 20 and one first cable 16 contacts three first pulleys 20. Similarly, one second cable 18 contacts one second pulley 20, one second cable 18 contacts two second pulleys 22 and one second cable 18 contacts three second pulleys 22. Each of first and second pulleys 20 and 22 act to direct the movement of first and second cables 16 and 18, respectively.

First and second cables 16 and 18 move in response to the turning of first and second cable reels 24 and 26 which are connected to first and second electric motors 28 and 30. Both first and second electric motors 28 and 30 are "two way" action motors. That is both first and second electric motors 28 and 30 can be operated to turn first and second cable reels 24 and 26, respectively, both clockwise and counterclockwise. Thus, when all first and second hooks 42 and 44 are engaged in first and second rings 38 and 40, respectively, first and second electric motors 28 and 30 can both be activated to lift or lower stretcher 14, as desired.

Motor control box 32 is in electrical communication with both first and second electrical motors 28 and 30. Motor control box 32 includes two first control buttons 46 and 48, and two second control buttons 50 and 52. Depressing first control button 46 and second control button 50 together will cause first and second electric motors 28 and 30, respectively, to be activated to cause first and second cable reels 24 and 26, respectively, to draw in first and second cables 16 and 18, thereby causing stretcher 14 to be lifted. Depressing first and second control buttons 48 and 52 together will cause first and second electric motors 28 and 30, to be activated to cause first and second cable reels 24 and 26, to release more and more of each first and second cable 16 and 18, respectively, thereby causing stretcher 14 to be lowered.

The action of first and second electric motors 28 and 30 is controlled by another means to avoid excessive lifting or lowering of stretcher 14. One of each of first and second cables 16 and 18 has attached to it a first pin 54 and a second pin 56. Attached to frame 12 and in electrical communication with first electric motor 28 are first top switch 58 and first bottom switch 60. Similarly, attached to frame 12 and in electrical communication with second electric motor 30 are second top switch 62 and second bottom switch 64. Each of these switches may be conventional and commercially available electric switches, e.g., microswitches. In any event, first top and bottom switches 58 and 60 act to deactivate first electrical motor 28 if first pin 54 contacts either of these first switches. Similarly, second top and bottom switches 62 and 64 act to deactivate second electric motor 30 if second pin 56 contacts either of these second switches. This deactivation occurs even if the first or second control button 46, 48, 50 and 52 which forced the pin switch contact remains depressed. In this manner the lifting and lowering of stretcher 14 is controlled within desired limits.

Body lift 10 functions as follows. Frame 12 is wheeled over a hospital bed 66, the linen on which requires changing. Second hooks 44 are disengaged from second rings 40 and first electric motor 28 is activated, by depressing first control button 48, to lower the first side end of stretcher 14. The patient 68 on the bed is then rolled onto stretcher 14 and second hooks 44 are again engaged with second rings 40. Second electric motor 30 may have to be activated, by depressing second contact button 52, to allow for this engagement.

With patient 68 confortably on the stretcher and second hooks 44 engages with second rings 40, first and second control buttons 46 and 50 are depressed simultaneously to lift stretcher 14 and patient 68 from the surface of bed 66. With stretcher 14 and patient 68 in this lifted position, frame 12 is wheeled away from bed 66 and the linens on bed 66 are changed.

Body lift 10 can be used to transport surgery patients from the operating room back to their own bed. In this application, body lift 10 would function in a manner substantially as set forth above, with bed 66 being replaced by an operating table.

In any event, when the linen on bed 66 has been changed or the surgery is completed, patient 68 in lifted stretcher is to be set down on bed 66. Frame 12 is again wheeled over bed 66. First and second control buttons 48 and 52 are depressed simultaneously to lower stretcher 14 until it and patient 68 are on the surface of bed 66. Second hooks 44 are disengaged from second rings 40. First control button 46 is depressed, thereby causing stretcher to move out from under patient 68. Some attendant assistance may be required to completely remove stretcher 14 out from under patient 66. Once this removal has been accomplished, patient 68 is resting comfortably in his own bed and body lift 10 is ready for a new assignment.

While this invention has been described with respect to various specific embodiments and examples, it is to be understood that the invention is not limited thereto and that it can be varuously practiced within the scope of the following claims.

What is claimed is:

1. An apparatus useful for lifting a human being from a surface, comprising stretcher means adapted to be placed between said human being and said surface, said stretcher means having substantially opposing first and second side ends and being capable of supporting said human being; first motive means comprising a first electric motor and a plurality of first cables associated with said first side end of said stretcher means, the operation of said first electric motor causing movement in said first cables and, in turn, the lifting or lowering of said first side end of said stretcher means, as desired; second motive means comprising a second electric motor and a plurality of second cables removably associated with said second side end of said stretcher means, the operation of said second electric motor causing movement in said second cables and, in turn, the lifting or lowering of said second side end of said stretcher means, as desired, provided that said first and second motive means are capable of independent operation; frame means acting to support said stretcher means and said first and second motive means; first and second switch means associated with said frame means and in electrical communication with said first and second motive means, respectively; and a first and a second contact block located on one of said first and second cables, respectively, and being capable of independently contacting said first and second switch means in response to the operation of said first and second electric motor respectively, whereby said contacting acts to deactivate said first and second electric motors and said movement of said first and second side end, respectively, of said stretcher means.

2. The apparatus of claim 1 wherein said frame means is portable.

3. The apparatus of claim 1 wherein said cables of said second motive means each include a ring or hook element adapted to be removably associated with a corresponding hook or ring element at or near said second side end of said stretcher means.

4. The apparatus of claim 1 wherein said first and second motive means each include three of said cables.

5. The apparatus of claim 4 wherein said first and second motive means further include first and second pulley systems, respectively, which act to direct the movement of said cables of said first and second motive means, respectively.

6. The apparatus of claim 1 wherein each of said first and second switch means includes an upper switch and a lower switch each of which is in electrical communication with said first and second electric motors, respectively, provided that contacting between said upper or lower switch and said contact block acts to deactivate the appropriate electric motor and said movement of the appropriate side end of the stretcher means, whereby the placement of said upper and lower switches defines the range of up-down movement of the appropriate side end of said stretcher means.

* * * * *